United States Patent [19]

Layton

[11] 4,009,967

[45] Mar. 1, 1977

[54] ROAD ROLLER VEHICLE WITH WATER APPLICATOR

[75] Inventor: Claude D. Layton, Salem, Oreg.

[73] Assignee: Layton Manufacturing Co., Inc., Salem, Oreg.

[22] Filed: Dec. 8, 1975

[21] Appl. No.: 638,747

[52] U.S. Cl. ..... 404/129; 239/223

[51] Int. Cl.[2] ..... E01C 19/26

[58] Field of Search ..... 404/129, 122; 239/214, 239/223

[56] References Cited

UNITED STATES PATENTS

| | | | |
|---|---|---|---|
| 572,447 | 12/1896 | Puffer | 404/129 |
| 1,722,907 | 7/1929 | Liddle | 404/129 |
| 2,830,511 | 4/1958 | Wills | 404/129 X |
| 3,071,051 | 1/1963 | Martin | 404/129 X |
| 3,478,962 | 11/1969 | Wirth | 239/223 X |

*Primary Examiner*—Nile C. Byers, Jr.
*Attorney, Agent, or Firm*—Kolisch, Hartwell, Dickinson & Stuart

[57] ABSTRACT

Apparatus for directing confined sheet-like sprays of water onto the surfaces of rollers in a ground-compacting vehicle.

8 Claims, 6 Drawing Figures

ROAD ROLLER VEHICLE WITH WATER APPLICATOR

BACKGROUND AND SUMMARY OF THE INVENTION

This invention pertains to apparatus for directing a confined sheet-like spray of water onto the ground-contacting surface of a roller in a ground-compacting vehicle, or the like.

In the laying of various surfaces, such as an asphalt concrete surface for a road or a parking lot, what is known as a road roller vehicle is often used for final compacting and densifying of the concrete. Such a vehicle usually takes the form of a frame, in some instances a two-piece hinged frame, mounted for travel on a pair of rollers that are weighted, which rollers produce the compacting action as the vehicle moves over the ground. Typically, water is sprayed onto the outside surfaces of the rollers during operation in order to prevent concrete from sticking to them.

The present invention focuses on a unique arrangement for wetting the outside surfaces of such rollers, which arrangement is intended to avoid some of the problems and disadvantages that have been encountered with conventional wetting apparatus. More specifically, the usual road roller vehicle contains one or more tanks for holding water, with these tanks being connected to a pumping apparatus which in turn is connected to nozzles that direct sprays of water onto the surfaces of rollers. A conventional nozzle arrangement would include a plurality of nozzles distributed along a pipe which is mounted along a line that substantially parallels the rotational axis of a roller.

One of the problems which has been encountered in the past is that existing water-spray systems use a substantial amount of water, and it is often necessary during a work shift for an operator to refill the water tanks. Often when this is done out on the job various kinds of dirt get into the tanks, and after a period of time may foul a pump and may cause clogging of the nozzles. Another drawback is that the time required for refilling of water tanks is, essentially, down-time for the equipment. Hence, it increases the cost of doing a job.

Still another disadvantage is that when the road roller vehicle moves along an inclined surface where the rollers are tilted along their rotational axes, water distribution by conventional gravity feed water-spray systems is not uniform. In other words, one end of a roller may receive water and the other end no water. Still a further consideration is that a pumping system with multiple nozzles is quite costly, and thus adds to the overall expense of a vehicle. Further, nozzles can represent a considerable maintenance problem, particularly where clogging and fouling result from the use of dirty water.

Therefore, a general object of the present invention, as has been suggested earlier, is to provide a unique water-spray system for use in conjunction with a road roller vehicle, and the like, which system avoids these various drawbacks of prior art systems.

According to a preferred embodiment of the invention, what is proposed is a flat rotary disk which is driven by a small motor, and is located on the underside of a vehicle's frame, with the disk being disposed in a plane which substantially parallels the plane of the ground underlying the vehicle. Water tanks on the vehicle communicate, through gravity flow, with this disk by way of conduits which simply extend from the tanks to points immediately overlying the disk. As will become more fully explained, the particular embodiment of the invention which is illustrated and described herein includes a pair of such conduits, with solenoid-operated valves provided for allowing or shutting off the flow of water.

During operation of the proposed system, the disk is rotated by the motor, and water is spilled onto the top surface of the disk, at a selected rate, by one or more of the conduits. This action results in a sheet-like spray of water being ejected from the disk as it spins, with this spray being directable onto the ground-contacting surfaces of the rollers. Associated with the disk is a housing which is configured, as will be described, to confine the spaces around the disk through which water may be ejected to escape the housing. In particular, two spaces are defined herein for the escape of water, which spaces are sized so that sprays of water are directed in a laterally confined manner onto the front and rear rollers. Such sprays, where they strike the rollers, have a width which is substantially the same as the lengths of the rollers.

With such a system, the problems of pumping, pump fouling, and nozzle clogging are completely avoided. Gravity flow is used for flowing the water. A single device, the rotary disk, mounted intermediate the front and rear rollers functions to provide an operative spray of water for both of the rollers. This spray is confined so that it does not appreciably overspray the rollers, i.e., spray beyond the ends of the rollers, and hence water wastage is held to a minimum. With the rotational plane of the rotary disk remaining at all times substantially parallel to the plane of the underlying ground, tilting of a roller during operation will not result in parts of the drums not being lubricated.

These and other objects and advantages which are attained by the invention will become more fully apparent as the description which now follows is read in conjunction with the accompanying drawings.

DETAILED DESCRIPTION OF THE INVENTION

Figure 2:
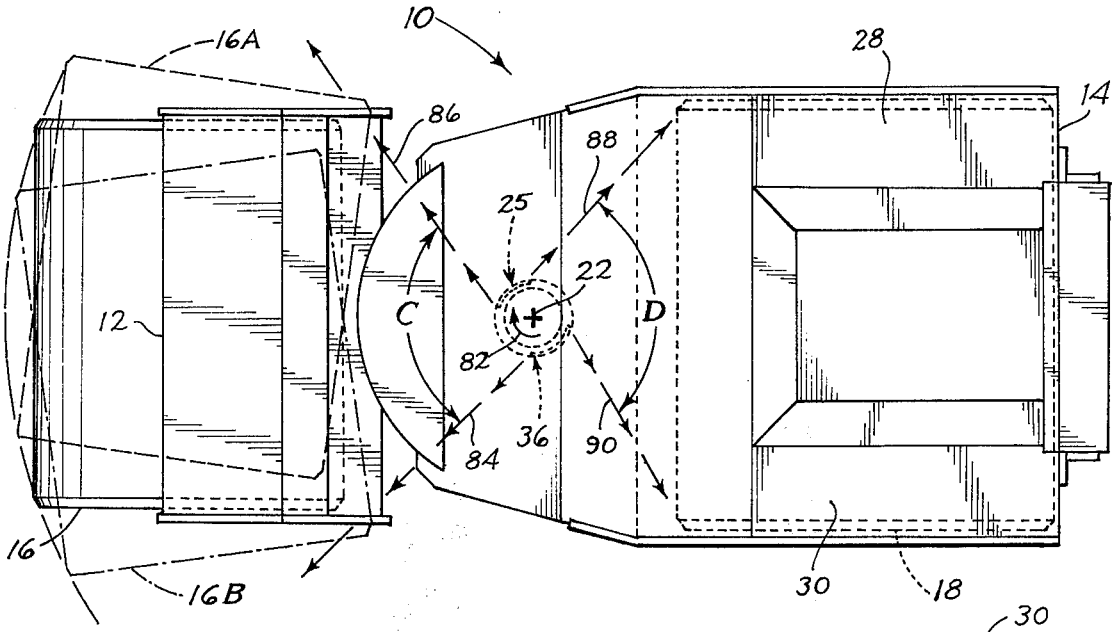
FIG. 2 is a top plan view of the vehicle of FIG. 1 showing the front roller therein in different positions which it might occupy during operation of the vehicle.
Figure 1:
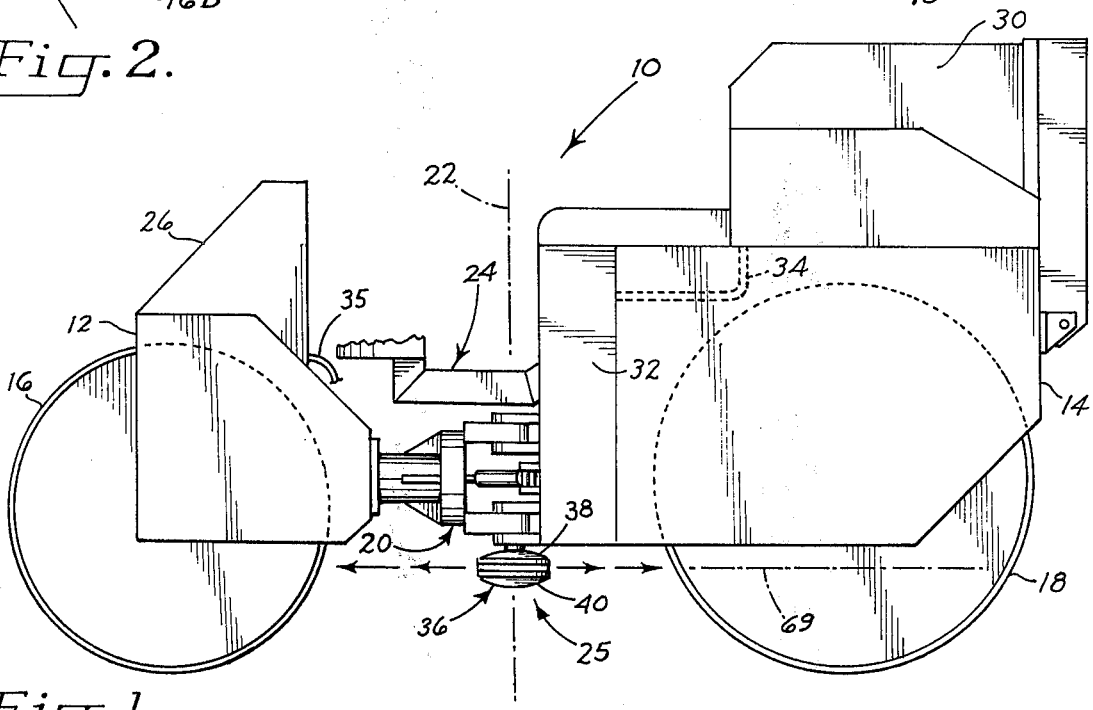
FIG. 1 is a simplified side elevation of a road roller vehicle incorporating apparatus constructed in accordance with the present invention.

Turning now to the drawings, and referring first to FIGS. 1 and 2, indicated generally at 10 is an articulated road roller vehicle including front and rear frame sections 12, 14, respectively, which are supported for movement over the ground by front and rear wheels, or rollers, 16, 18, respectively. Sections 12, 14 interconnect through a hinge assembly 20 (see FIG. 1) for swinging about the generally upright axis shown at 22. Except for the incorporation therein of a water-spray system made in accordance with the present invention, vehicle 10 is conventional. The rollers are weighted in the usual manner, with the rear roller used to impart drive to the vehicle by virtue of its having a driving connection with the engine (concealed) in the vehicle.

Mounted in the usual way on the rear frame section is an operator platform and seat shown generally at 24 in FIG. 1. Steering of the vehicle is accomplished by pivoting of frame section 12 with respect to section 14. For example, and considering particularly FIG. 2, roller 16 and frame section 12 are shown in solid outline in the positions that they occupy with the vehicle steered to drive in a straight line. Roller 16 is shown in dashed lines at 16A in a position for producing a right turn of the vehicle as such advances in the forward direction; and in dash-dot outline at 16B roller 16 is shown in a position for producing a left turn of the vehicle as it advances forwardly.

Indicated generally at 25 is a portion of a water-delivery means, or system, which is included in vehicle 10 in accordance with the present invention. Water is supplied in this system from a plurality of water storage tanks, or means, shown at 26, 28, 30, 32. Conduits, or conduit means, such as the conduit shown at 34 in FIG. 1, connect tanks 28, 30 with tank 32. A flexible hose 35 (shown broken off) connects tank 26 and tank 32. Such conduits are referred to herein collectively as gravity water feed means.

Figure 5:
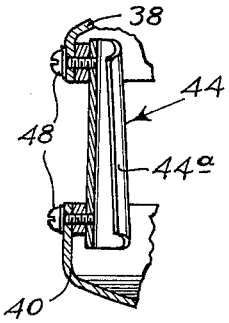
FIGS. 4 and 5 are cross-sectional views taken along the lines 4—4 and 5—5, respectively, in FIG. 3.
Figure 3:
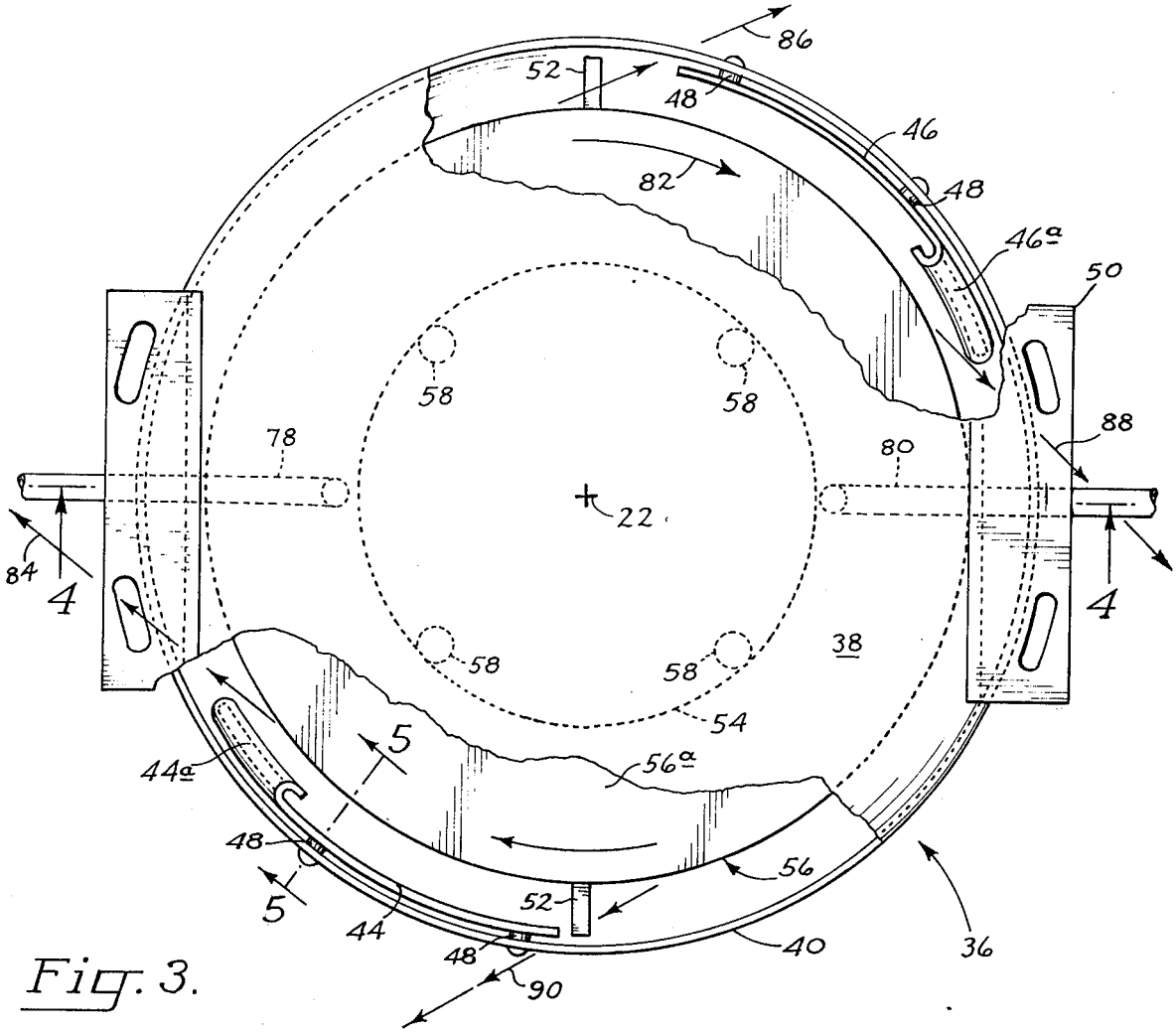
FIG. 3 is an enlarged top plan view of water-delivery means forming part of the apparatus of the invention, with this means being shown herein detached from the vehicle of FIGS. 1 and 2.
Figure 4:
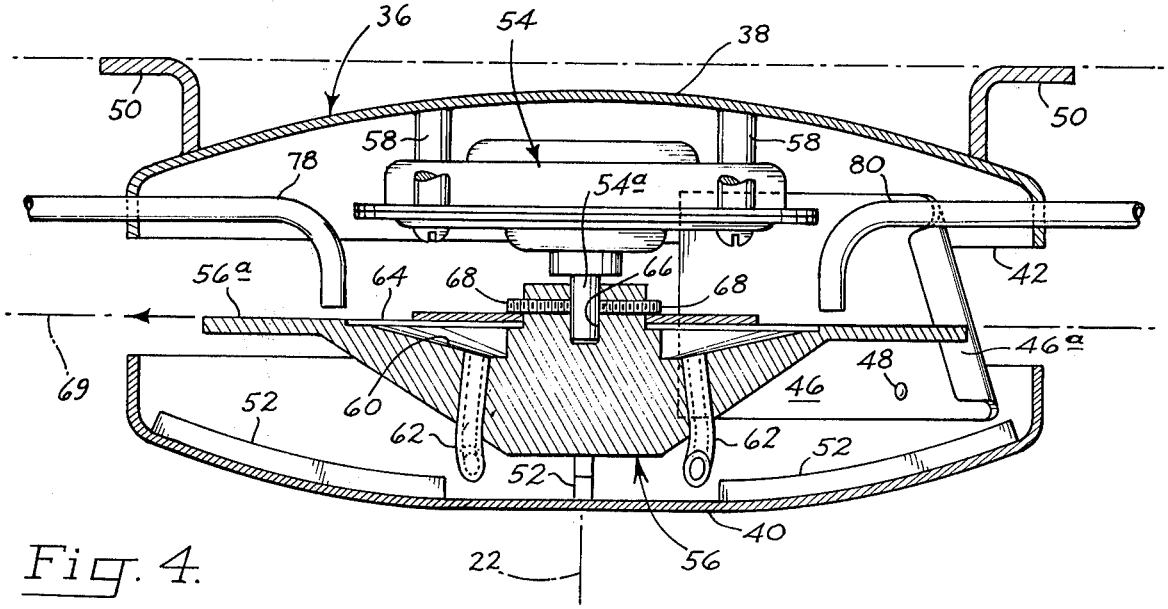

Referring now to FIGS. 3, 4 and 5 along with FIGS. 1 and 2, included as a portion of system 25 is a water-spray device, or means, 36. As can be seen particularly in FIGS. 1 and 2, device 36 is mounted on the underside of frame section 14, along previously mentioned hinge axis 22.

Included within device 36 are upper and lower, generally circular bowl-shaped parts 38, 40, respectively, which are vertically spaced to define a generally circular slot 42. Parts 38, 40 are interconnected through a pair of diametrically opposed curved plates 44, 46 which, together with the bowl-shaped parts, function as what is referred to herein as a confining means or a shield means. The right end **46*a* of plate 46 in FIGS. 3 and 4 is angled with respect to the vertical as shown, and is reversely bent. Similarly, the left end 44*a* of plate 44 in FIG. 3 is likewise angled and reversely bent. Plates 44, 46 are attached to parts 38, 40 through screw assemblies such as those shown at 48 in FIGS. 3, 4 and 5.**

Brackets 50 which are joined to the top of part 38 mount device 36 on frame section 14. The angular position shown for device 36 in FIG. 3 with respect to axis 22 is rotated 90° clockwise from that shown for the device in FIG. 2. As will become apparent, the angular positions of plates 44, 46 in the finally mounted condition of device 36 are important.

Mounted on the upwardly facing concave surface of part 40 are a plurality of radially extending vanes, such as those shown at 52 in FIGS. 3 and 4. Four such vanes are provided. Also disposed within parts 38, 40 are an electric motor, or power-operated means, 54, and a rotary member 56, as contemplated by the invention. Motor 54 herein is a flat-configuration DC motor, such as the motor known as the "Pancake" which is made by the PMI Division of Kollmargen Corporation of New York. The motor is mounted on the underside of part 38 through mounts such as those shown at 58. The output shaft **54*a* of the motor is positioned with its rotational axis coincident with previously mentioned axis 22. Power for operating the motor is supplied from the conventional electrical system provided on vehicle 10.**

Rotary member 56 herein is formed with the cross-sectional configuration shown in FIG. 4. Thus, member 56 includes a flat, generally annular face **56*a* which is referred to herein as a spray-ejecting face. This face, along its inner margin, communicates with a generally conical hollow region 60, which in turn communicates through a pair of conduits 62 with the hollow interior of part 40. Conduits 62 are mounted on member 56 through suitable accommodating bores provided in the member, with the lower ends of these conduits being bent to extend generally in a plane paralleling that of face 56*a*. More specifically, the lower end of right-hand conduit 62 in FIG. 4 is bent toward the viewer, and the lower end of the left-hand conduit in the figure is bent away from the viewer. These lower ends of conduits 62** constitute scoop means herein, with the hollow interiors of the conduits being referred to as passage means herein.

Mounted in the plane of face **56*a* is an annular screen 64 which overlies hollow region 60 and rests on suitable shoulders provided on member 56. This screen functions, as will be explained, as a filter in device 36. A central upwardly facing bore 66 in member 56 receives shaft 54*a*, with member 56 being locked to the shaft by set screws 68. Thus, member 56 is mounted for rotation about axis 22.**

As mounted on vehicle 10, member 56 is disposed with face **56*a* lying in a plane 69 which substantially parallels the plane of the ground unerlying the vehicle. As can be seen in FIG. 1, plane 69 intersects rollers 16, 18 beneath frame sections 12, 14.**

Figure 6:
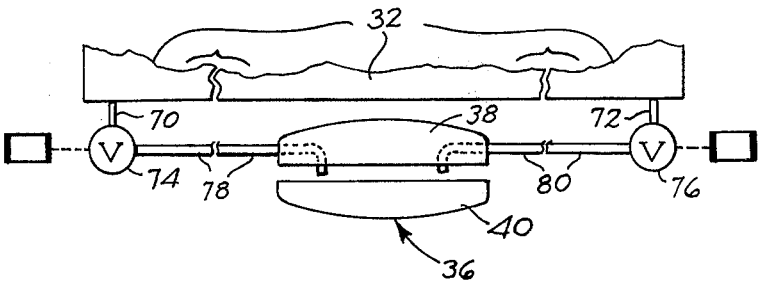
FIG. 6 is a simplified view showing certain conduits and valves which are used in the apparatus of the invention.

Considering now FIG. 6, along with FIGS. 3 and 4, extending from the opposite sides of the bottom of tank 32 are conduits 70, 72 which communicate through solenoid-operated valves 74, 76, respectively, with conduits 78, 80, respectively. The end portions of conduits 78, 80 which are away from valves 74, 76 extend through diametrically opposite sides of bowl-shaped part 38, and are therein down-turned to face the spray-ejecting face on member 56. Power for operating valves 74, 76 is supplied from the vehicle's electrical system, with the controls for opening and closing the valves being suitably positioned adjacent the operator's seat on the vehicle. These two valves are adjusted to produce different flow rates of water from tank 32 into conduits 78, 80. In particular, valve 74 permits a relatively low rate of flow into conduit 78, with valve 76 permitting a somewhat greater rate of flow into conduit 80. The exact flow rates are not critical and are a matter of choice, but preferably are different, as will be appreciated, in order to accommodate different rates of water lubrication for rollers 16, 18.

Explaining now how the apparatus of the invention performs, when it is desired to wet rollers 16, 18 with water, one or both of valves 74, 76 are opened to allow water to flow by gravity from tank 32 into conduits 78, 80. It will be apparent that three different flow rates are possible — the lowest resulting from valve 74 alone being open, the next highest resulting from valve 76 alone being open, and the highest resulting from both valves being open. Motor 54 is turned on to cause member 56 to spin. A rate of revolution which has been found to be satisfactory is about 2,000 rpm. Member 56 herein turns in the direction of arrow 82 (see FIGS. 2 and 3).

With spinning of member 56, water which flows through either or both of conduits 78, 80 spills onto face 56a whereupon it is ejected from this face as a thin circular sheet which lies substantially in plane 69.

Plates 44, 46 confine this spray whereby only portions of the full circular spray are ejected from device 36 through slot 42. In particular, two portions escape device 36, with these portions moving toward rollers 16, 18. Referring to FIGS. 2 and 3, the lateral margins of the portion of spray which escapes toward roller 16 are shown at 84, 86. This portion is confined within the angle indicated at C in FIG. 2. Similarly, the lateral margins of the portion of the spray which escapes toward roller 18 are shown at 88, 90. This portion is confined within the angle indicated at D in FIG. 2. As can thus be seen, plates 44, 46 are positioned and sized whereby the lateral margins of escaping portions of the spray, where the spray strikes the rollers, substantially coincide with the lateral dimensions of the rollers. This situation minimizes overspray and hence water wastage.

Thus, the two rollers are simultaneously wetted by thin sheet-like sprays of water which, where these sprays strike the rollers, strike along lines substantially within plane 69. The portions of spray ejected by face 56a which strike plates 44, 46 are directed downwardly into the hollow interior of part 40, where a pool of water collects that is scooped up by the lower ends of conduits 62. Vanes 52 minimize swirling of the water in this pool. Water which is collected by conduits 62 flows upwardly into hollow region 60, thence through screen 64, and thence onto face 56a where it is ejected again. Thus, not only is wastage inhibited by confining the lateral margins of escaping sprays, but also by recirculating water which has struck plates 44, 46.

It will be apparent, therefore, that a very simple, economical, and effective system is provided by the invention for wetting the rollers in a road roller vehicle. But a single water-spray device, mounted on the underside of a vehicle's frame, is required simultaneously to wet both rollers. No nozzles are needed. Nor is any pump required. Thin sprays of water are directed onto the ground-contacting surfaces of the rollers in a plane which substantially always parallels the plane of the underlying ground surface. Accordingly, regardless of the angular tilt of a vehicle, the entire lengths of both rollers are properly and uniformly lubricated. Further, it will be noticed in FIG. 2 that regardless of the angular position of roller 16 as the result of steering of vehicle 10, wetting of substantially the full length of the roller will still take place.

It will also be appreciated that a relatively simple water-feed arrangement is accomplished where gravity is used for the supply of water. Water which is drawn from tank 32 is replenished by water from tanks 26, 28, 30.

With water ejected as a thin spray onto the rollers, and with these sprays confined as described, and through the use of a recirculating system which captures water that has previously not been ejected as a spray, a relatively small amount of water is required for continuous lubrication of the rollers. Accordingly, but a single filling of the tanks in a vehicle will usually be all that is required to supply the lubrication needs of the rollers throughout the usual daily work shift.

The apparatus of the invention is obviously quite simple in construction, and of course, may be modified to accommodate the particular roller configuration in a vehicle. For example, there might be a vehicle in which it is desired to lubricate but a single roller with a device like device 36, and this is of course possible through proper configuring of shield parts like plates 44, 46.

Any dirt which might tend to accumulate in water which has been exposed to the air will be caught by filter screen 64.

Thus, it is believed apparent how the apparatus of the invention overcomes the disadvantages of prior art water lubricating systems, and offers the various advantages ascribed to it earlier. While a preferred embodiment of the invention has been described herein, it is appreciated that variations and modifications may be made without departing from the spirit of the invention.

It is claimed and desired to secure by Letters Patent:

1. In a ground-traveling vehicle including a frame, a wheel rotatably mounted on said frame rotatable about a substantially horizontal axis and adapted to transport the vehicle over the ground, and a spin-operated water-delivery means also mounted on said frame spaced in a direction extending laterally of the wheel's rotation axis beyond the perimeter of the wheel and adapted to be supplied with water, said water-delivery means including a rotatable spray ejecting member rotatable about an upright axis and adapted when rotated and with water supplied thereto to throw such water from the periphery of the member as a spray, said member producing a spray pattern which impinges on the perimeter of the wheel in a zone extending transversely of the width of the wheel perimter, said water-delivery means including means confining the spray pattern to substantially the width of the perimeter of the wheel.

2. In a ground-traveling vehicle including a frame, a wheel rotatably mounted on said frame for rotation about a substantially horizontal axis extending transversely of the longitudinal axis of the vehicle adapted to transport the vehicle over the ground, said wheel including a ground-contacting face extending about the perimeter of the wheel, and a spin-operated water-delivery means mounted on said frame at a location spaced longitudinally along said vehicle from the wheel rotation axis, and intermediate the laterally opposite sides of said wheel, said water-delivery means including a rotatable spray ejecting member rotatable about an upright axis and adapted when rotated and with water supplied thereto to throw such from the periphery of the member as a spray, said member producing a spray pattern impinging on the perimeter of said wheel in a zone substantially paralleling its axis and extending across the face which forms the perimeter of the wheel, said water-delivery means including means confining the spray pattern to substantially the lateral dimensions of said face.

3. In a ground-traveling vehicle including a frame, a ground-compacting roller rotatably mounted on and at least partially supporting said frame having a horizontal rotation axis which extends generally transversely of the longitudinal axis of the vehicle, and water-spray means mounted on said frame spaced longitudinally on the vehicle from said roller and positioned intermediate the roller's opposite ends for directing a spray of water onto and along the length of the roller, said water-spray means including a rotatable spray ejecting member rotatable about an upright axis and adapted when rotated and with water supplied thereto to throw such from the periphery of the member as a spray, said member producing a spray pattern which impinges on the perimeter of the roller in a zone extending along the length of the roller.

4. In a ground-traveling vehicle including an elongated frame, a forward and a rear ground-engaging roller mounted adjacent opposite ends of said frame and supporting the same for travel over the ground, and spin-operated water-spray means mounted on said frame intermediate said rollers operable to produce a water spray ejected outwardly in opposite directions from said spray means with such spray occupying two confined spray patterns, one of said spray patterns extending forwardly from the water-spray means and impinging on said forward roller in a zone extending substantially horizontally of the roller and the spray pattern being confined to substantially the lateral dimensions of the forward roller as measured generally transversely of the longitudinal axis of the vehicle, the other spray pattern extending rearwardly from the water-spray means and impinging on said rear roller in a zone extending substantially horizontally of the roller and the spray pattern being confined substantially to the lateral dimensions of the rear roller as measured generally transversely of the longitudinal axis of the vehicle.

5. A traveling ground-compacting vehicle comprising front and rear frame sections hinged for relative swinging about a substantially vertical axis, front and rear ground-traveling rollers mounted on and supporting said front and rear frame sections, respectively, each roller being mounted for rotation about a substantially horizontal axis which extends substantially transversely of its associated frame section's longitudinal axis, and each roller including a ground-contacting surface extending about the perimeter thereof, water storage means mounted on at least one of said frame sections above said rollers, spin-operated water-spray means mounted on and beneath said frame sections intermediate said rollers operable to produce a water spray ejected outwardly in opposite directions from said spray means in two confined spray patterns, one of said spray patterns extending forwardly from the water-spray means and impinging on said forward roller in a zone extending substantially horizontally of the roller, the spray pattern being confined substantially to the lateral dimensions of the ground-contacting surface in the roller, the other of said spray patterns extending rearwardly from the spray means and impinging on the rear roller in a zone extending substantially horizontally of the roller and the spray pattern being confined substantially to the lateral dimensions of the ground-contacting surface of the rear roller, such confining of the spray patterns being effective to minimize overspray, and gravity water feed means for supplying water from said water storage means to said water-spray means.

6. In a ground-traveling vehicle including a frame and a wheel rotatably mounted on said frame for rotation about a substantially horizontal axis and adapted to support the vehicle for movement over the ground, a spin-operated water delivery means mounted on said frame and spaced in a direction extending laterally of the wheel's rotation axis beyond the perimeter of the wheel, said water-delivery means including a rotatable spray ejecting member rotatable about an upright axis and adapted when rotated and with water supplied thereto to throw such from the periphery of the member as a spray, said member producing a spray pattern which impinges on the perimeter of said wheel in a zone extending transversely of the width of the wheel perimeter, said water-delivery means including shield structure operable to confine lateral limits of the spray pattern impinging on said wheel to substantially the width of the perimeter of the wheel, said shield structure partially surrounding said rotary member and deflecting spray thrown from the periphery of the member.

7. The ground-traveling vehicle of claim 6, wherein said water-delivery means further includes recirculating means for recirculating water deflected by said shield structure to return such against said rotating member.

8. The ground-traveling vehicle of claim 7, wherein said vehicle includes a water reservoir for storing water and which further includes gravity feed means for supplying water from said storage means to said rotatable spray ejecting member and wherein said recirculating means is powered by rotation of said rotatable member.

* * * * *